US008701527B2

(12) United States Patent
Towne

(10) Patent No.: US 8,701,527 B2
(45) Date of Patent: Apr. 22, 2014

(54) LOCKING ADJUSTABLE WRENCH

(76) Inventor: William Towne, Yorba Linda, CA (US)

( * ) Notice: Subject to any disclaimer, the term of this patent is extended or adjusted under 35 U.S.C. 154(b) by 503 days.

(21) Appl. No.: 12/647,335

(22) Filed: Dec. 24, 2009

(65) Prior Publication Data

US 2011/0154956 A1 Jun. 30, 2011

(51) Int. Cl.
*B25B 13/22* (2006.01)

(52) U.S. Cl.
USPC ..... 81/145; 81/165; 81/170

(58) Field of Classification Search
USPC ..... 81/145, 165, 170
See application file for complete search history.

(56) References Cited

U.S. PATENT DOCUMENTS

| | | | | |
|---|---|---|---|---|
| 3,024,683 | A * | 3/1962 | Finn et al. | 81/165 |
| 4,344,339 | A | 8/1982 | Penner | |
| 4,380,941 | A | 4/1983 | Petersen | |
| 5,154,103 | A | 10/1992 | Lewis, Jr. | |
| 5,540,125 | A | 7/1996 | Haskell | |
| 5,644,957 | A * | 7/1997 | Gustafson et al. | 81/165 |
| 5,644,960 | A | 7/1997 | O'Brien | |
| 6,679,139 | B2 * | 1/2004 | Brenizer | 81/165 |
| 7,275,464 | B2 | 10/2007 | Chervenak et al. | |

* cited by examiner

*Primary Examiner* — Lee D Wilson
*Assistant Examiner* — Shantese McDonald
(74) *Attorney, Agent, or Firm* — Kenneth L. Green

(57) ABSTRACT

An adjustable wrench is capable of locking and of free and indexed opening and closing of jaws. The wrench operates by means of a multipurpose shaft. The shaft controls an adjustment screw to allow free movement of the wrench jaws, increment adjusting of the jaws, or locking of the jaws in place.

13 Claims, 4 Drawing Sheets

LOCKING ADJUSTABLE WRENCH

BACKGROUND OF THE INVENTION

The field of the present invention is wrenches, especially adjustable and locking wrenches.

The field of wrenches is old, and very crowded with a myriad of types suited for various tasks. A few of these are discussed here in relation to the current invention.

In U.S. Pat. No. 7,275,464, which issued on Oct. 2, 2007, inventors Chervenak et al describe a ratchetable wrench comprising a pliable handle, wherein the handle is rotated to lock the jaws of the wrench.

Inventor William O'Brien reveals a parallel, slidable and lockable jaw wrench in U.S. Pat. No. 5,644,960, which issued on Jul. 8, 1997. This wrench includes ball bearings disposed within a channel.

On Jul. 30, 1996, U.S. Pat. No. 5,540,125 issued to inventor Arthur Haskell. This patent illustrates an adjustable wrench having selectable locking positions. This wrench also comprises ball bearings.

U.S. Pat. No. 5,154,103 issued to inventor Barney Lewis, jr., on Oct. 13, 1992. This patent has a subject a lock, slidably mounted on a crescent wrench.

In U.S. Pat. No. 4,380,941, which issued on Apr. 26, 1983, inventor Hyrum Petersen reveals a detachable and adjustable pipe wrench.

Finally, inventor John Penner describes a lockable crescent wrench in U.S. Pat. No. 4,344,339, which issued on Aug. 17, 1982.

SUMMARY OF THE INVENTION

The invention is drawn to a locking crescent wrench that is capable of free range motion and incremental, staged motion of the jaws. It is also capable of locking in place at any desired position within its range of motion.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DESCRIPTION OF THE PREFERRED EMBODIMENT

Detailed descriptions of the preferred embodiment are provided herein. It is to be understood, however, that the present invention may be embodied in various forms. Therefore, specific details disclosed herein are not to be interpreted as limiting, but rather as a basis for the claims and as representative basis for teaching one skilled in the art to employ the present invention in virtually any appropriately detailed system, structure or manner.

Figure 1:
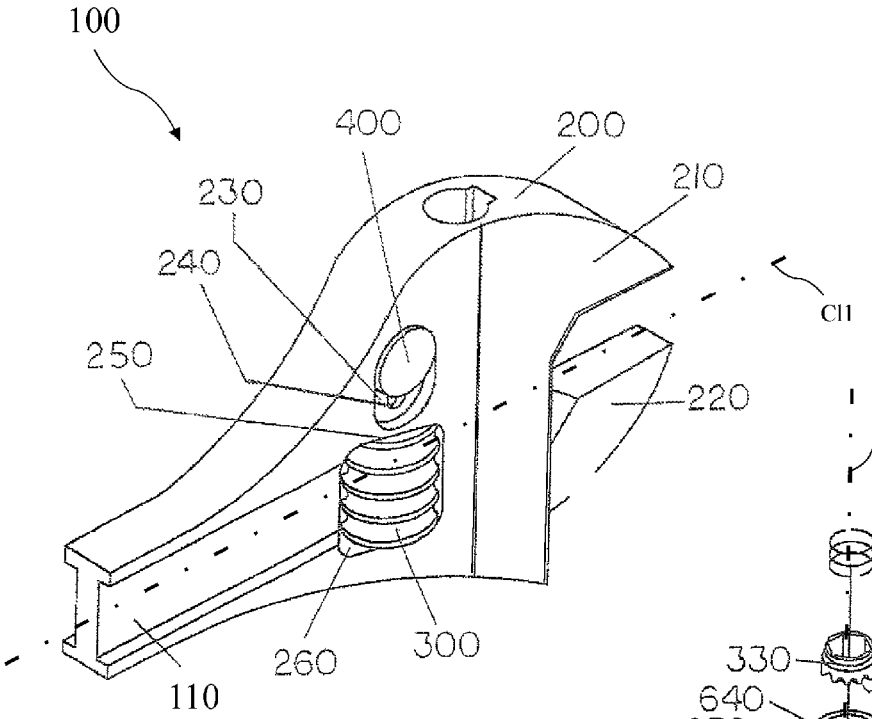
FIG. 1 is a perspective representation of the head of a wrench in a cutaway view and elements there of in accordance with a preferred embodiment of the present invention.

A Wrench 100 in accordance with a preferred embodiment of the present invention is portrayed in FIG. 1. Wrench frame 200 including a solid fixed jaw 210, the adjusting screw 300 which controls the movement of a moveable jaw 220 to open and close the jaws, a track and recessed area 230, and a shifting track or slot 240 for adjustment of a slide button 400 to select the position desired for the moveable jaw. Recessed area 230 forms a housing area for shifting track 240. A centerline CL1 runs through an elongated handle 110 of the wrench 100.

Slide button 400 in FIG. 1 is a round or elongated button, recessed into the main body via recessed area 230 for accuracy in shifting, protection from damage, and exclusion of foreign material from entering the shifting slot 240 in the main body 200.

Figure 2:
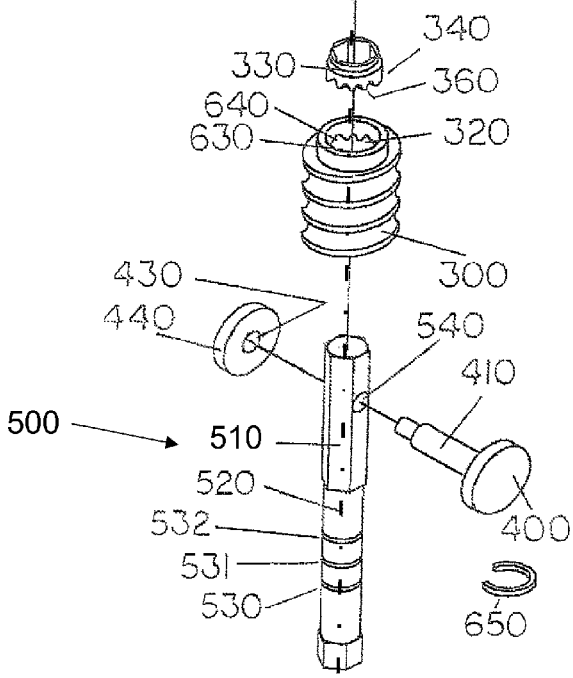
FIG. 2 is an exploded view of the indexing components, in accordance with a preferred embodiment of the present invention.

As portrayed in FIG. 2, slide button 400 has a horizontal shaft 410 for extending thru the wrench frame 200, and thru the hole 540 in the vertical shaft 500, thereby restricting the vertical shaft 500 from turning in the wrench frame 200. The shaft 410 is secured on the opposite side of the wrench frame 200 by a removable button 430. In a preferred embodiment, adjustments can be made to the assembled main body 200 making both slide button 400 and removable button 430 either left or right handed. An indexing ring 330 is pressed downward by spring 600 engaging indexing upper teeth 360 on the indexing ring 330 with lower indexing teeth 640 on the adjusting screw 300, and a centerline CL2 runs though the center of the adjusting screw 500.

Slide button 400 is utilized to shift the position of the shaft 500 to any of 3 available positions: free, indexing, and locking. The slide button 400 is attached to, on center, and perpendicular to the shaft 500.

A C Ring 650 found in FIG. 2 works in relationship to the shaft area 520, an element of shaft 500, at the opposite end of the adjustment screw 300. The adjusting screw 300 is pulled forward compressing the spring 600, and locating the adjusting screw 300 against the main body 200. The C ring 650 is pushed on the shaft diameter 520 and the adjusting screw 300 is then allowed to return to its original position, locating the C ring into the recessed area 625. Ring grooves 530, 531 and 532 locate and secure the shaft 500 in the desired position, as noted in FIG. 3, and later Figures.

Figure 3:
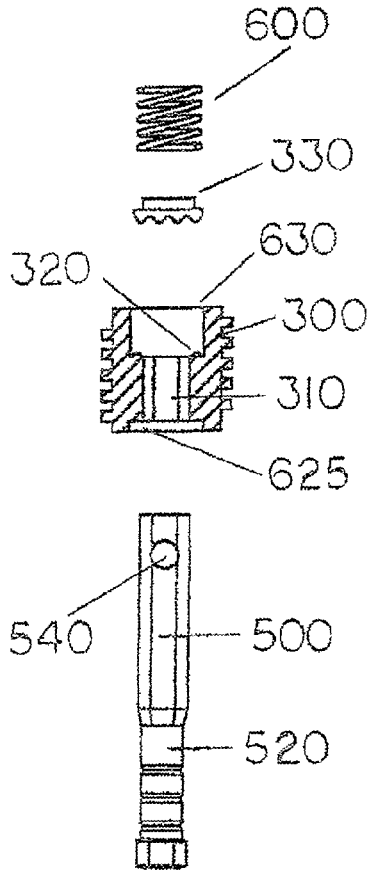
FIG. 3 is another exploded view of the indexing components, showing the adjusting screw in a cutaway view in accordance with a preferred embodiment of the present invention.

The spring 600 shown in FIG. 3 resides over the hexagonal shaft 500 applying pressure to the indexing ring 330 maintaining contact between the angular indexing configuration of the face of the indexing ring 330 and the angular indexing configuration on the face of the adjusting screw 300, as shown in FIG. 1 and FIG. 2. The spring pressure on the indexing ring 330 biases the adjusting screw 300 into angular alignment with the indexing ring 330. The spring clip 650 works in relationship to the shaft area 520 located in the recessed area 625 as seen in FIG. 3, at the opposite end of the adjustment screw 300.

Shaft 500 in FIG. 2 is displayed in hexagonal shape, as may be found in a preferred embodiment of the current invention. The shaft can also be square, octagonal, star, or of Spline configuration. The locating hole for the hexagonal shaft 500 in the main wrench body 200 can be round in shape, hexagonal, or identical to the configuration of the shaft. The points on the hexagonal (outside edges at the longer diameter angles of hexagonal shaft 500) will coordinate and have the same configuration with the center hole of the adjusting screw 300 and the indexing ring 330. When the shaft 500 passes thru the adjusting screw 300 and indexing ring 330, the ring restricts rotation. Thus, shaft 500 will not rotate about its long axis. A thru hole 540 perpendicular to the shaft will accept the shaft 410 of the slide button 400 to move the shaft 500 in a lateral direction.

As further demonstrated in FIG. 2, in a preferred embodiment, the shaft 500 has a smooth, rounded area 520 (on the lower portion of hexagonal shaft 500). This diameter will also coordinate with the inside diameter of the adjusting screw 300 and indexing ring 330. When the adjusting screw 300 and indexing ring 330 are in this position over the diameter area of the shaft 520 they will rotate freely. The transition 505 in FIG. 3, from the hexagonal shaft 510 (FIG. 1) to the round shaft 520 (FIG. 1) is tapered to enhance engagement of the hexagonal shaft to the indexing ring 330 in FIG. 6. This round area of the Shaft 520 has Grooves 530, 531, and 532 for locating and securing the Shaft 520 into the desired positions utilizing a C Ring 650.

Indexing ring 330 is preferably located between the compression spring 600 and adjusting screw 300, as shown in FIG. 3. The ring has the same center hole configuration as the hexagonal shaft 500 and thus is able to slide over the corresponding hexagonal shaft.

This center hole configuration in a preferred embodiment, may have points in multiples of six. By way of example, if the hexagonal shaft 500 has six points, the center hole may have six, twelve, eighteen, or higher multiple points, and still accept the hexagonal shaft 500. This will facilitate engagement of the hexagonal shaft 500. It will also have an indexing face 340, per FIG. 2.

The indexing face 340 is utilized on both the indexing ring 330 and the indexing face 320 on the adjustment screw 300 may take on a variety of different forms or types. As displayed for clarity in FIG. 2, teeth 340 will be utilized in a radial position. When assembled, the indexing face of the indexing ring 330 and the adjusting screw 300 will be mated together and their axial movements will be synchronized to those of the shaft 500.

Adjustment screw 300 is depicted in FIG. 3. When rotated, the outside thread of the adjustment screw 300 meshes with the rack gear on the moveable jaw, moving the moveable jaw 220 in either direction. The center hole 310 (FIG. 2) in the adjusting screw 300, having the configuration of the hexagonal shaft is able to slide over the corresponding hexagonal shaft 500. The center hole configuration may have 6 points, or multiples of six points. For example: If the hexagonal shaft 500 has six points, the center hole may have six, twelve, eighteen, or higher multiples of 6. This will facilitate engagement of the hexagonal shaft 500. The recessed area 630 (FIG. 4) in the end of the adjustment screw 300 (FIG. 2) has an indexing face mating to the indexing ring 330.

Figure 4:
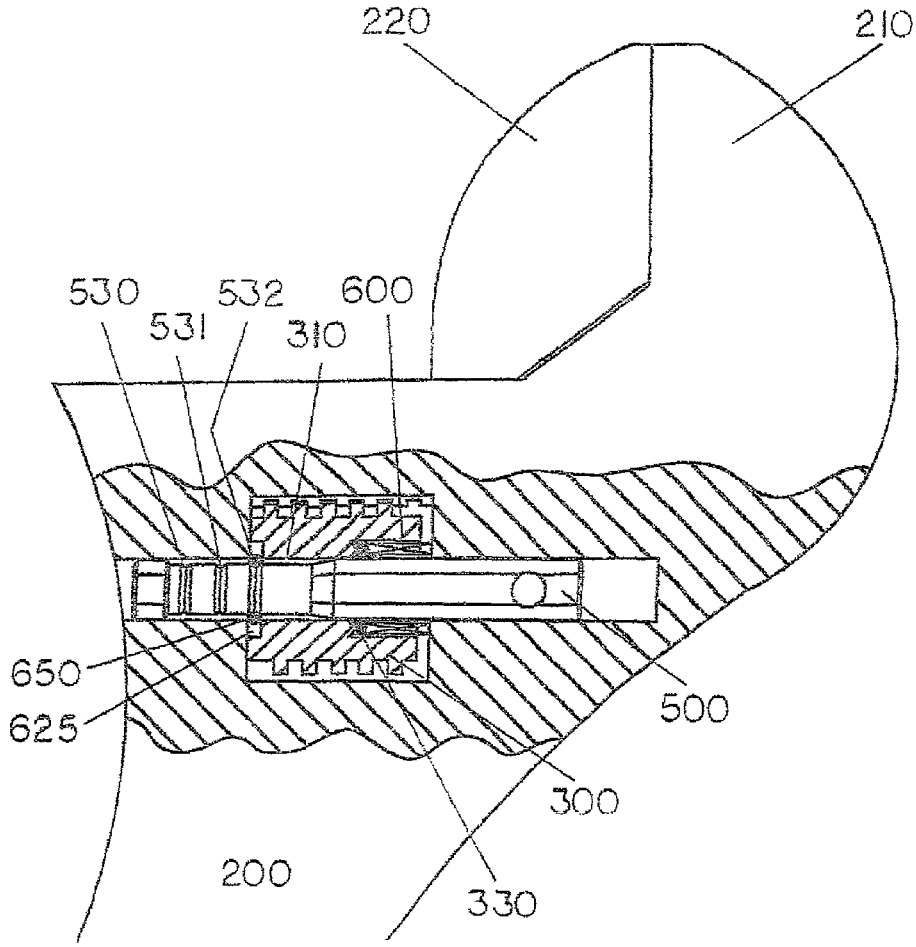
FIG. 4 is a perspective representation of a preferred embodiment of the wrench of the current invention, in the assembled position and cutaway view showing the components of the assembly.

FIG. 4 is a perspective representation of the head of a wrench, showing the adjusting screw 300 thereof, in accordance with a preferred embodiment of the present invention. Adjustment screw 300 is shown in cutaway side view. Shaft 500 is shown in the locked position, as will be further described below.

Figure 5:
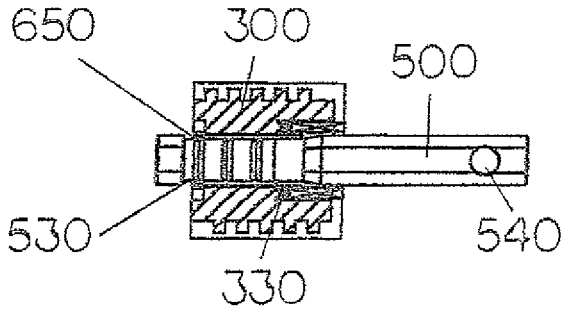
FIG. 5 is an enlarged representation of the position of the shaft, in the free mode in accordance with a preferred embodiment of the present invention.
Figure 6:
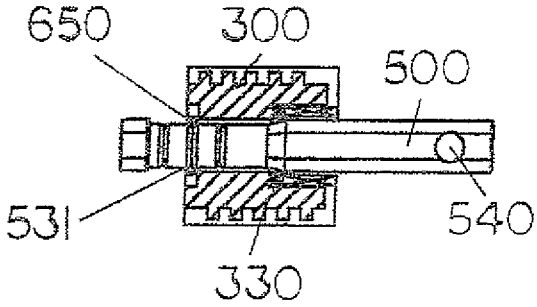
FIG. 6 is an enlarged representation of the position of the shaft in the indexing mode in accordance with a preferred embodiment of the present invention.
Figure 7:
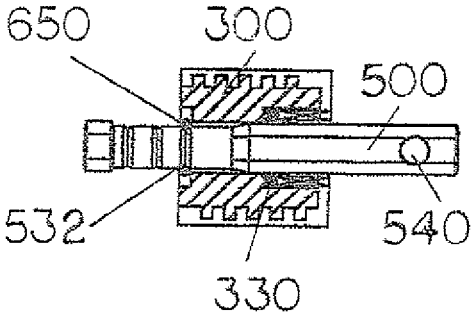
FIG. 7 is an enlarged representation of the position of the shaft, in the locking mode in accordance with a preferred embodiment of the present invention.

The wrench of the current invention preferably has three stages, as described in the following section and as depicted in FIGS. 5, 6, and 7. FIGS. 5, 6, and 7 are enlarged images of the three stages of operation described above. FIG. 5 shows the free stage, with the shaft 500 at the first stop within adjusting screw 300. FIG. 6 shows the free stage, with the shaft 500 at the second stop within adjusting screw 300. FIG. 7 shows the locked stage, with the shaft 500 at the final stop within adjusting screw 300.

Free Position

In the Free Position shown in FIG. 5, the wrench 100 works like any other adjustable wrench utilizing the Adjustment Screw 300 to move the Movable Jaw 220 (FIG. 1). The slide button 400 is in the top position and the vertical Shaft 500 is moved up to disengage the hexagonal portion 510 from both the indexing ring 330 and the adjusting screw 300, and the vertical shaft 500 is secured in this position by the C Ring 650 in Groove 530.

Indexed Adjusting Position

The Indexed Adjusting Position is shown in FIG. 6. This stage permits the adjusting screw 300 to rotate in increments of 0 to 360 degrees, determined by the number of teeth and the like on the face of the indexing ring 330 (FIG. 4) corresponding to the mating face located on the face of the adjusting screw 300 (FIG. 4). Moving the slide button 400 to the middle position simultaneously moves the shaft 500 to the middle position engaging the indexing ring 330 and secures it from turning by the configuration of the shaft 500 corresponding to the center hole in the indexing ring 330. The C Ring 650 will slide on the round diameter 520 (FIG. 7), and will be secured in this middle position by the groove 531 on the Shaft 500 with the Indexing Ring 330 secured on the hexagonal shaft 510. C Ring 650 will not turn, as the Compression Spring 600 holds it in place. This allows the adjusting screw 300 to be rotated over 360 degrees and indexes, by pushing the spring loaded indexing ring 330 away from the adjusting screw, to the desired degrees set by the geometric configuration of the indexing ring face 340 (FIG. 4) and the mating configuration in the adjusting screw 300 (FIG. 4). This will determine the amount of movement of the Movable Jaw 220 per FIG. 1.

Example

Utilizing a Ten Inch Adjustable Wrench

TABLE I

Angular Indexing Table

| No. of Teeth | Rotation | Movement of Moveable Jaw |
|---|---|---|
| 1 | 360 Degrees | .090 Thousands |
| 3 | 120 Degrees | .030 Thousands |
| 6 | 60 Degrees | .015 Thousands |

Locked Position

When the desired position of the moveable jaw 220 is achieved by rotating the adjustment screw 300, locking of the adjusting screw 300 (see FIG. 7) is accomplished by moving the slide button 400 down. This movement simultaneously moves the shaft 500 to the locking position, closest to the adjusting screw 300. This in turn will move the shaft 500 thru the indexing ring 330, and into the adjusting screw 300. The alignment is synchronized by the geometry of the indexing ring 330 to the shaft 500. As shown in FIG. 7, the shaft will be secured in this position by the spring clip 650 sliding on the round diameter 520, and being secured in this position by groove 532 in the shaft 500.

FIG. 5 is a view of the adjusting screw 300 and its components, in accordance with a preferred embodiment of the present invention. The elements of the control mechanism are shown to the left. In enlarged view, the adjusting screw 300 and the upper and lower gears are shown to the right. The beveled teeth of the gears are designed to mate, such that the face of lower gear 640 fits snugly into the face of upper gear 360. Advancement of the lower jaw toward or away from the upper jaw is achieved by turning the adjusting screw 300.

The position of shaft 500 governs the choice of degree of movement of the lower jaw. This effect is shown in FIG. 2. At the bottom, shaft 500 is viewed in expanded format. At the top of shaft 500 are three grooves (in descending order from the top) 532, 531, and 530. The shaft position is governed by the actuator button 400.

When the wrench user moves the actuator button 400 to the first stop, the shaft 500 rests at the free stage, with groove 532 even with the edge of adjusting screw 300 as depicted in the free stage in FIG. 6 C. In this position, the adjusting screw 300 can be turned freely, and the lower jaw 220 correspondingly moved freely within its limits of travel.

When the wrench user moves the actuator button 400 further to the to the second stop, the shaft 500 comes to rest at the index stage, with groove 531 even with the edge of adjusting screw 300 as depicted in the index stage in FIG. 6 B. In this position, the adjusting screw 300 can be turned incrementally, and the lower jaw 220 correspondingly moved incrementally, step by step, within its limits of travel. The increment depends on the overall size of wrench 100 and particularly upon the size and number of gear teeth in gears 640 and 360. The greater the number of teeth, the smaller the incremental travel of jaw 220 with each turn of the adjusting screw 300.

Finally, when the wrench user moves the actuator button 400 to the last stop, the shaft 500 rests at the locking stage, with groove 530 even with the edge of adjusting screw 300 as depicted in the locking stage in FIG. 6 C. In this position, the adjusting screw 300 cannot be turned, and the lower jaw 220 correspondingly locks at its current position.

Thus, if a user wants to adapt to a given range of travel—let us say, to drive nuts in the metric range of 10 to 20 millimeters in diameter—he will select a wrench having the appropriate size and number of teeth in gears 640 and 360, as displayed in FIG. 2. Using the index stage of FIG. 6, the user will adjust the wrench via turning the adjusting screw 300 until the separation between the jaws reaches a given nut size, for example 15 millimeters. This can be done by observation, although use of a gauge or other measuring device is appropriate as needed. Moving the actuator button 400 to the last stop will then lock the wrench jaws. This locks the wrench in position to operate on the given nut size. If the operator needs to adjust the wrench size, the operator simply repeats the process by moving the actuator button 400 to the second stop, adjusting the adjusting screw 300 to change the jaw width incrementally, then moving actuator button 400 to the last stop to lock the jaws into the desired separation. This is a preferred mode of operation of the invention when the sizes of the objects to be operated upon are known and fairly standardized in diameter.

If the sizes of said objects are not known, or vary in unknown ways, the free stage operation mode is a preferred mode. In that case, the wrench operator will again select a wrench having the appropriate size and number of teeth in gears 640 and 360. Using the free stage of FIG. 5, the user will adjust the wrench via turning the adjusting screw 300 until the separation between the jaws reaches a given separation width, as appropriate. This again can be done by observation, although use of a gauge or other measuring device is appropriate as needed. Moving the actuator button 400 to the last stop will then lock the wrench jaws. This locks the wrench in position to operate on the given nut size. If the operator needs to adjust the wrench size, the operator simply repeats the process by moving the actuator button 400 to the first stop, adjusting the adjusting screw 300 to change the jaw width incrementally, then moving actuator button 400 to the last stop to lock the jaws into the desired separation.

The advantage of the incremental or indexed stage operation is that is reaches a desired jaw width more quickly and repeatably than the free stage. Jobs can often be performed more quickly with the incremental stage mode. However, the free stage allows for closer tailoring of the jaw width, especially in cases of non-standard widths of workpieces, where the optimum jaw width may lie in between increments.

While the invention has been described in connection with a preferred embodiment or embodiments, it is not intended to limit the scope of the invention to the particular form set forth, but on the contrary, it is intended to cover such alternatives, modifications, and equivalents as may be included within the spirit and scope of the invention as defined by the appended claims.

I claim:

1. A locking adjustable wrench, comprising:

a wrench frame comprising:

an elongated handle; and a stationary jaw, fixedly attached to one end of said handle;

a movable jaw attached to the wrench frame and opposed to said stationary jaw, and movable with respect to said stationary jaw;

an adjusting screw cooperating with the moveable jaw, wherein rotation of the adjusting screw in a first direction moves the moveable jaw towards the stationary jaw, and rotation of the adjusting screw in an opposite direction moves the moveable jaw away from the stationary jaw, the adjusting screw having a center hole with a polygonal interior cross-section; and a vertical shaft, rotationally fixed and capable of longitudinal movement in a direction parallel to a centerline CL2 of the adjusting screw, said vertical shaft comprising:

a polygonal portion slidably engagable into and disengagable from the polygonal interior cross-section of the adjusting screw; and a cylindrical portion slidable through the polygonal interior cross-section of the adjusting screw, wherein the vertical shaft has a first position wherein the polygonal portion is disengaged from the polygonal cross-section of the adjusting screw and the adjusting screw is free to rotate to open and close the moveable jaw; and the vertical shaft has a second position wherein the polygonal portion is engaged with the polygonal cross-section of the adjusting screw and the adjusting screw is locked to lock the moveable jaw.

2. The locking adjustable wrench of claim 1, wherein: said adjusting screw includes an upward facing first rotary indexing surface; and an indexing ring resides above the adjusting screw and includes a downward facing second rotary indexing surface residing against the first rotary indexing surface, and cooperation of the first rotary indexing surface with the second rotary indexing surface aligns the polygonal portion of the vertical shaft with the polygonal interior cross-section of the adjusting screw.

3. The locking adjustable wrench of claim 2, further comprising an indexing spring to bias said indexing ring against the upward facing first rotary indexing surface of the adjusting screw.

4. The locking adjustable wrench of claim 3, wherein the indexing ring includes a vertical polygonal passage, and the polygonal portion of the vertical shaft is slidably engagable into and disengagable from the vertical polygonal passage.

5. The locking adjustable wrench of claim 4, wherein:

the polygonal portion of the vertical shaft is a hexagon;

the vertical polygonal passage through the indexing ring and the polygonal cross-section of the adjusting screw have a number of sides N equal to a multiple of six; and the indexing surfaces provide N uniformly angularly spaced apart indexing positions of the adjusting screw with respect to the indexing ring.

6. The locking adjustable wrench of claim 4, wherein N is six.

7. The locking adjustable wrench of claim 1, further including:

a button exposed on a side of the wrench frame; and a horizontal arm attached to the button and reaching through the wrench frame and through a hole in the vertical shaft to rotationally fix the vertical shaft.

8. The locking adjustable wrench of claim 7, wherein said button is vertically slideable to longitudinal move the vertical shaft between the first position and the second position.

9. The locking adjustable wrench of claim 8, wherein said slideable button is sheltered in a recessed area of the wrench frame.

10. The locking adjustable wrench of claim 1, further including a springed clip held in a fixed position in the wrench frame and residing on the vertical shaft, the vertical shaft capable of sliding movement through the springed clip.

11. The locking adjustable wrench of claim 10, wherein said vertical shaft includes at least two longitudinally spaced apart annular grooves to hold the vertical shaft in the first position and in the second position.

12. A locking adjustable wrench, comprising:

a wrench frame comprising:

an elongated handle; and a stationary jaw, fixedly attached to one end of said handle;

a movable jaw attached to the wrench frame and opposed to said stationary jaw, and movable with respect to said stationary jaw;

an adjusting screw cooperating with the moveable jaw, wherein rotation of the adjusting screw in a first direction moves the moveable jaw towards the stationary jaw, and rotation of the adjusting screw in an opposite direction moves the moveable jaw away from the stationary jaw, the adjusting screw including:

an upward facing first rotary indexing surface; and a center hole with a polygonal interior cross-section;

an indexing ring resides above the adjusting screw and includes a downward facing second rotary indexing surface residing against the first rotary indexing surface, the indexing ring including a vertical polygonal passage;

an indexing spring to bias said indexing ring against the upward facing first rotary indexing surface of the adjusting screw; and a vertical shaft, rotationally fixed and capable of longitudinal movement in a direction generally perpendicular to a long axis of said wrench;

said vertical shaft comprising:

a polygonal portion slidably engagable into and disengagable from the vertical polygonal passage of the indexing ring and engagable into and disengagable from the polygonal interior cross-section of the adjusting screw; and a cylindrical portion slidable through the vertical polygonal passage of the indexing ring and the polygonal interior cross-section of the adjusting screw, wherein the vertical shaft has a first position wherein the polygonal portion is disengaged from the vertical polygonal passage of the indexing ring and from the polygonal cross-section of the adjusting screw, and the adjusting screw is free to rotate to open and close the moveable jaw;

the vertical shaft has a second position wherein the polygonal portion of the vertical shaft is engaged with the vertical polygonal passage of the indexing ring to prevent rotation of the indexing ring, and disengaged from the polygonal cross-section of the adjusting screw and the adjusting screw is free to rotate to open and close the moveable jaw and is biased into rotational position wherein the polygonal portion of the vertical shaft is aligned with the polygonal cross-section of the adjusting screw; and the vertical shaft has a third position wherein the polygonal portion is engaged with the polygonal cross-section of the adjusting screw and the adjusting screw is locked to lock the moveable jaw.

13. A locking adjustable wrench, comprising:

a wrench frame comprising:

an elongated handle; and a stationary jaw, fixedly attached to one end of said handle;

a movable jaw attached to the wrench frame and opposed to said stationary jaw, and movable with respect to said stationary jaw;

an adjusting screw cooperating with the moveable jaw, wherein rotation of the adjusting screw in a first direction moves the moveable jaw towards the stationary jaw, and rotation of the adjusting screw in an opposite direction moves the moveable jaw away from the stationary jaw, the adjusting screw having a center hole with a polygonal interior cross-section; and a vertical shaft, rotationally fixed and capable of longitudinal movement in a direction parallel to a centerline CL2 of the adjusting screw, said vertical shaft comprising:

a polygonal portion slidably engagable into and disengagable from the polygonal interior cross-section of the adjusting screw; and a cylindrical portion slidable through the polygonal interior cross-section of the adjusting screw, wherein the vertical shaft has a first position wherein the polygonal portion is disengaged from the polygonal cross-section of the adjusting screw and the adjusting screw is free to rotate to open and close the moveable jaw;

the vertical shaft has a second position wherein the polygonal portion is engaged with the polygonal cross-section of the adjusting screw and the adjusting screw is locked to lock the moveable jaw;

a button exposed on a side of the wrench frame; and a horizontal arm attached to the button and reaching through the wrench frame and through a hole in the vertical shaft to rotationally fix the vertical shaft, said button vertically slideable to longitudinal move the vertical shaft between the first position and the second position.

* * * * *